US008672132B2

(12) United States Patent
Ramirez et al.

(10) Patent No.: US 8,672,132 B2
(45) Date of Patent: Mar. 18, 2014

(54) PACKING TRAY WITH BUILT-IN DRAINAGE AND METHOD OF MANUFACTURE

(75) Inventors: Richard L. Ramirez, Lawrenceville, GA (US); Mark A. Bergeron, Monroe, GA (US)

(73) Assignee: Tekni-Plex, Inc., King of Prussia, PA (US)

( * ) Notice: Subject to any disclaimer, the term of this patent is extended or adjusted under 35 U.S.C. 154(b) by 55 days.

(21) Appl. No.: 13/307,844

(22) Filed: Nov. 30, 2011

(65) Prior Publication Data

US 2013/0134067 A1 May 30, 2013

(51) Int. Cl.
*B65D 81/02* (2006.01)
*B65D 85/00* (2006.01)

(52) U.S. Cl.
USPC ..... 206/521.1; 206/564; 206/521.8

(58) Field of Classification Search
USPC ..... 206/564, 562, 521.1, 521.8; 220/516, 220/513, 507
See application file for complete search history.

(56) References Cited

U.S. PATENT DOCUMENTS

| | | | | | |
|---|---|---|---|---|---|
| 3,040,923 | A | * | 6/1962 | Leitzel | 217/26.5 |
| 3,049,259 | A | * | 8/1962 | Mazzi et al. | 217/26.5 |
| 3,315,410 | A | * | 4/1967 | French | 47/65.7 |
| 3,695,453 | A | * | 10/1972 | Martelli | 211/14 |
| 3,937,390 | A | * | 2/1976 | Winkler | 229/119 |
| 4,506,799 | A | * | 3/1985 | Mason, Jr. | 220/628 |
| 5,597,073 | A | * | 1/1997 | Kocis | 206/564 |
| 6,811,050 | B2 | | 11/2004 | Bergeron | |

* cited by examiner

*Primary Examiner* — J. Gregory Pickett
*Assistant Examiner* — Blaine Neway
(74) *Attorney, Agent, or Firm* — Novak Druce Connolly Bove + Quigg LLP

(57) ABSTRACT

Packing tray for packing fruit and other fragile objects including a drainage system that channels water away from the fruit. The packing tray includes a plurality of cell pockets, each cell pocket having a lowermost sump area with at least one flap door punched out but not removed from the sump area, providing a drainage opening from the cell. Inner and outer cell pocket channels are provided on both the inner and outer surfaces of the cell pockets to direct water flow and removal.

20 Claims, 6 Drawing Sheets

PACKING TRAY WITH BUILT-IN DRAINAGE AND METHOD OF MANUFACTURE

FIELD OF THE INVENTION

The present invention relates to packing trays for packing food items such as fruit, and other fragile objects.

BACKGROUND

Packing trays having an array of cell pockets are commonly used to package fragile objects to enable their safe storage, transport and/or display. In particular, some pulp fiber trays designed to hold fruit (or other perishable food items) have a hole in the bottom of each cell pocket for air or moisture ventilation but such holes have limited functionality and the hole can easily be sealed off by the article being held therein. Without adequate drainage, watermarks due to moisture or condensation will form on the fruit causing it to more readily spoil or become bruised or damaged. This is particularly true with food items that are transported long distances in varying climates, e.g., from a relatively warm (or cooler) temperature where the fruit is harvested, to a relatively cool (or warmer) temperature where it will be consumed. Also, the perishable food item may be placed in and removed from cold storage at various times, following packing and before ultimate consumption. With exposure to such wide ranges of temperatures and humidity, moisture and/or condensation may form on the perishable item leading to bruising, spoilage and watermarks. Thus, there is a need for a packing tray that provides sufficient protection from both the mechanical forces encountered during packaging, shipment and/or storage, and that also prevents damage due to moisture or condensation on the items being packed.

SUMMARY OF THE INVENTION

In accordance with one embodiment of the invention, a packing tray is provided for protecting fragile objects, such as perishable food items, which includes a drainage system to facilitate removal of moisture or condensation away from the fragile object. The tray includes a plurality of cell pockets, each cell pocket having a lowermost sump area with at least one flap door punched out but not removed from the sump area, providing a drainage opening from the cell. Inner and outer cell pocket channels are provided on the inner and outer surfaces of the cell pockets respectively to effect water flow and removal. The inner channels direct water flow or moisture to the bottom sump area and drainage hole(s), while the outer channels on the back side of the cell pockets assist with drainage through the opening(s) and moisture removal.

Preferably, the sump area is formed with a reduced cell wall thickness compared to an adjacent wall thickness of the cell pocket. This provides enhanced flexibility of the one or more flap doors forming the drainage hole(s).

Preferably, the inner and outer drainage channels provide a more flexible tray to facilitate one or more of processing, loading, handling, and/or unloading product from the tray.

Preferably, the channels are disposed at a different area of the cell pockets then where the item being held makes contact with the cell pocket.

Preferably, the tray is unitarily formed of a sheet of plastic material, such as polystyrene foam.

Preferably, the cell pockets are separated by cell dividers that provide one or more of: a surface for engaging a fragile object held in an adjacent tray (immediately above or below a first tray) when multiple trays are stacked one above the other; and/or an area for collecting moisture away from the fragile object. Preferably, the cell pockets and cell dividers form a partially enclosed volume for holding each fragile object securely between two trays stacked one above the other.

In one embodiment, the tray can be economically manufactured from a sheet of plastic material, the cell pockets are formed by molding, and the one or more flap doors by punching out but not removing a portion of the sump area.

In accordance with one embodiment of the invention, a packing tray of plastic material is provided for packing fragile objects, the packing tray comprising:

- a peripheral edge extending about the perimeter of the tray, the peripheral edge having an upper surface defining a reference plane;
- a plurality of cell pockets formed in the tray extending transversely from the reference plane to accommodate fragile objects to be packed in the cell pockets;
- each cell pocket having a lowermost sump area having at least one flap door punched out but not removed from the cell pocket forming an opening in the cell pocket;
- a plurality of drainage channels on an inner surface of the cell pocket for directing moisture to the sump area; and
- a plurality of drainage channels on an outer surface of the cell pocket intersecting at the sump area to assist with drainage through the opening.

In one embodiment, the tray includes cell dividers separating the cell pockets and disposed a lesser distance from the reference plane than the sump areas.

In one embodiment, the cell pockets and cell dividers are arranged to enable a first stacking tray to be stacked on a second packing tray when the trays are rotated 180 degrees.

In one embodiment, the sump area has a lesser wall thickness than an adjacent area of the cell pocket.

In one embodiment, the sump area includes two flap doors forming two openings.

In one embodiment, the cell pockets are arranged in longitudinal rows, with cell pockets in alternating rows having cell pocket centers offset and equidistant from the cell pocket centers in an adjacent row.

In one embodiment, the tray includes an even number of the cell pockets are included in a first row and an odd number of the cell pockets are included in a second row adjacent to the first row.

In one embodiment, the first row includes one more cell pocket than the second row.

In one embodiment, the plastic material comprises one or more of polystyrene, polyester, polyolefin, polypropylene (PP)), or polylactic acid (PLA), including homopolymers, copolymers, mixtures and blends thereof, and including virgin and reclaimed (recycled) materials.

In one embodiment, the plastic material comprises polystyrene foam.

In one embodiment, the tray is unitarily formed.

In one embodiment, each cell divider and the adjacent cell pockets form a generally convexly shaped portion on a lower surface of the tray.

In one embodiment, each cell divider includes an upper surface shaped to channel water to an adjacent cell product.

In accordance with another embodiment of the invention, a stack of packing trays is provided comprising at least two packing trays stacked one on top of the other with the fragile objects disposed in the cell pockets and the second tray rotated 180 degrees with respect to the first tray.

In accordance with another embodiment of the invention, a method of making the packing tray includes providing a unitary sheet of plastic material; forming the cell pockets in the sheet by molding; and punching out the at least one flap door in the sump area of each formed cell pockets.

In accordance with another embodiment of the invention, a packing tray of plastic material is provided for packing fragile objects, the packing tray comprising a peripheral edge extending about the perimeter of the tray, the peripheral edge having an upper surface defining a reference plane; a plurality of cell pockets formed in the tray extending transversely from the reference plane to accommodate fragile objects to be packed in the cell pockets; each cell pocket having a lowermost sump area comprising a recess in an upper surface of the cell pocket and having at least one flap door punched out but not removed from the cell pocket forming an opening in the cell pocket; a plurality of drainage channels extending radially on an inner surface of the cell pocket for directing moisture to the sump area; and a plurality of drainage channels extending radially on an outer surface of the cell pocket and intersecting at the sump area to assist with drainage through the opening.

In accordance with one embodiment of the invention, the cell dividers separating the cell pockets are disposed a lesser distance from the reference plane than the sump areas, wherein the cell pockets and cell dividers are arranged to enable a first stacking tray to be stacked on a second packing tray when the trays are rotated 180 degrees.

In accordance with one embodiment, each cell divider and the adjacent cell pockets form a generally convexly shaped portion on a lower surface of the tray.

DETAILED DESCRIPTION

FIGS. 1-9 show a packing tray 10 according to one embodiment of the invention. The packing tray 10 is formed from a single sheet of polystyrene foam and is preferably formed with substantially complimentary upper and lower surfaces so that the packing tray 10 can be stacked in nesting engagement with similarly-shaped packing trays 10. The packing tray is particularly well-suited for packing fruit and other perishable food items, but can also be used to pack other types of fragile objects, such as light bulbs. The present embodiment is a non-limiting example of the invention.

Figure 2:
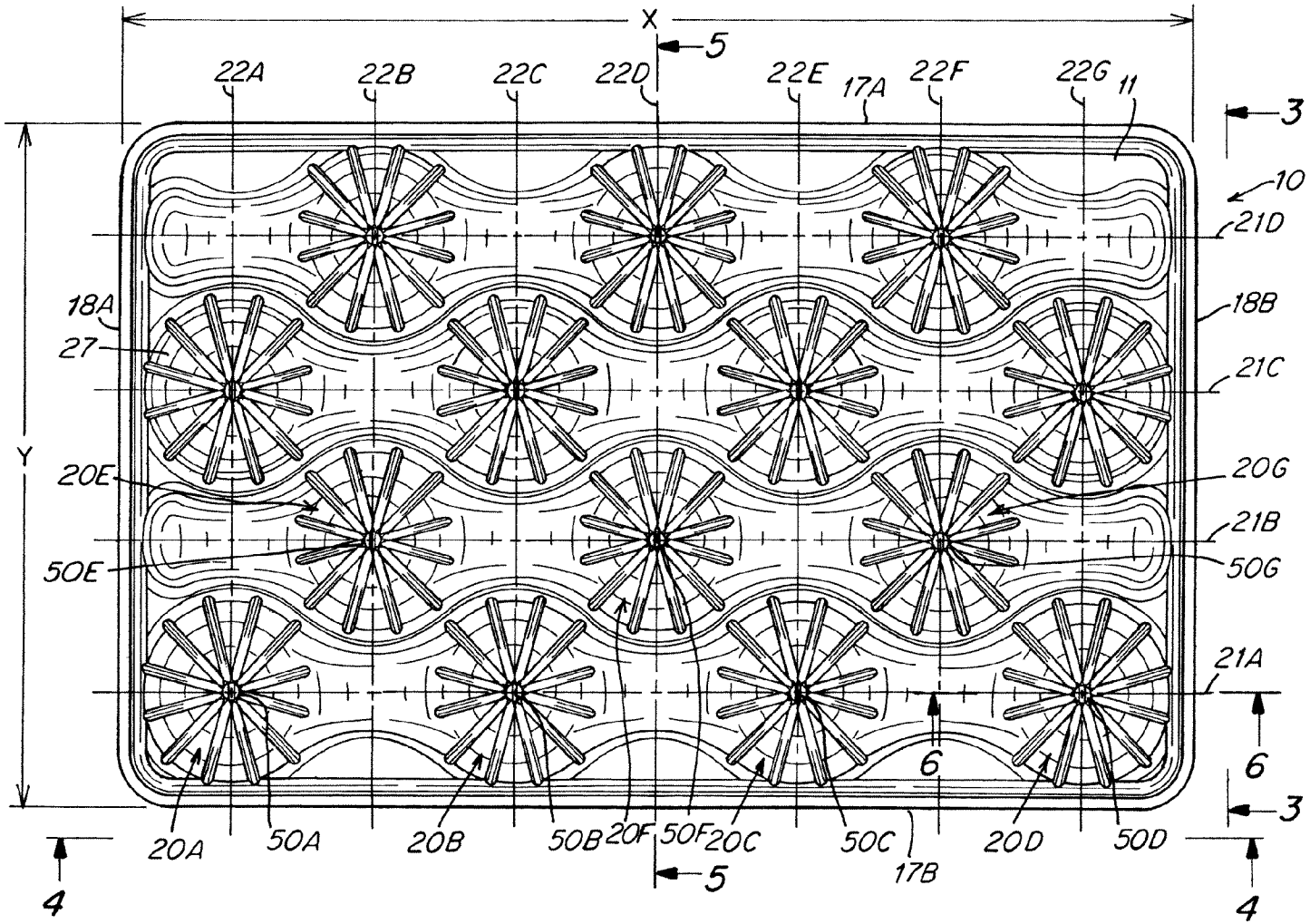
FIG. 2 is a top plan view of the tray of FIG. 1.
Figure 3:
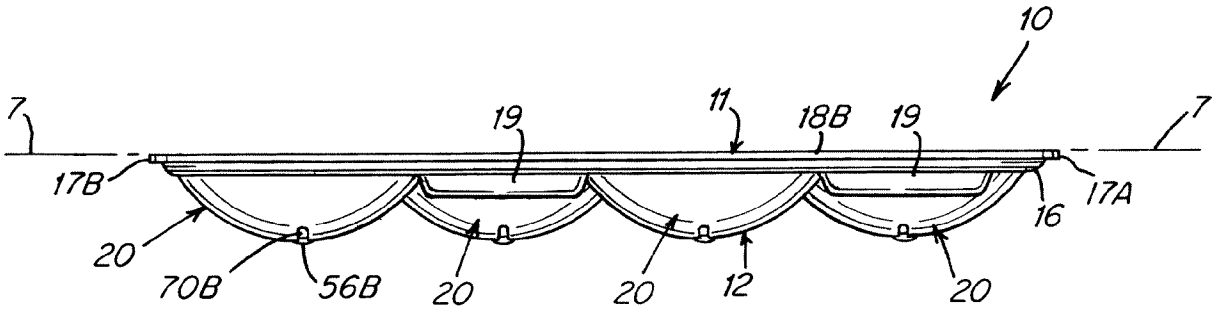
FIG. 3 is a right side elevational view as seen along line 3-3 of FIG. 2.
Figure 4:
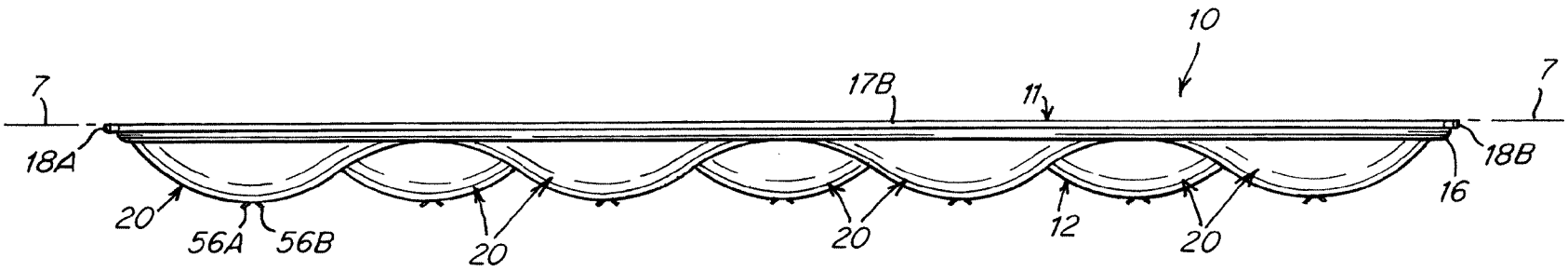
FIG. 4 is a front elevational view as seen along line 4-4 of FIG. 2.
Figure 5:
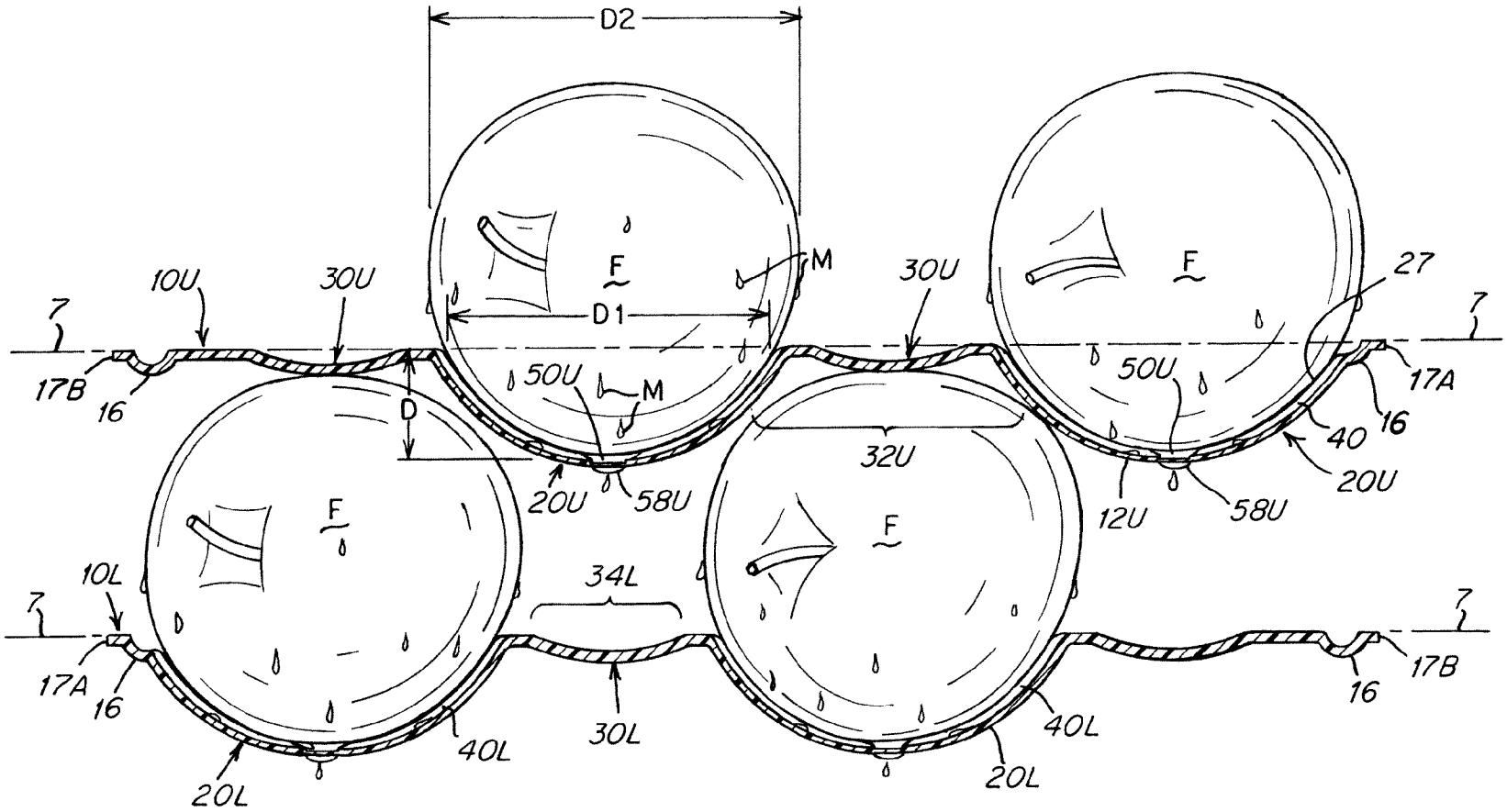
FIG. 5 is a schematic cross-sectional lateral view taking along line 5-5 of FIG. 2, but showing two trays stacked with fruit.
Figure 9:
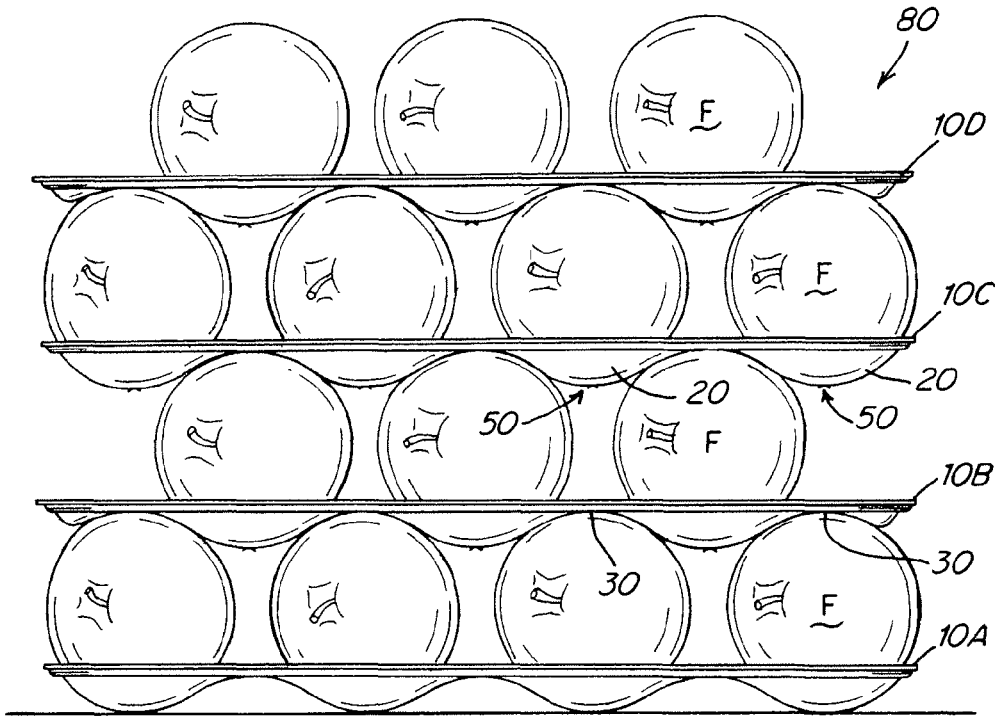
FIG. 9 is a schematic elevational view of a stacked set of trays with fruit.
Figure 10:
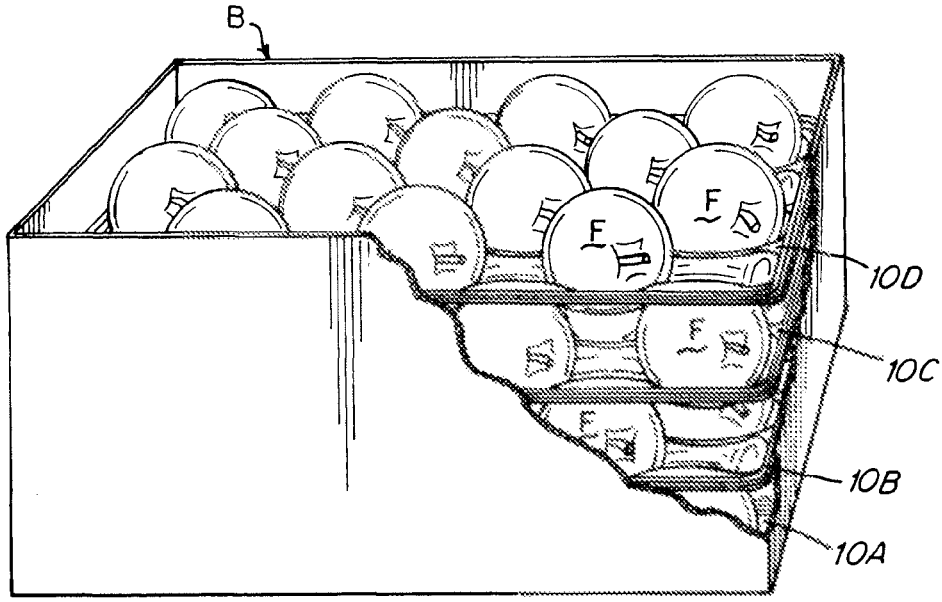
FIG. 10 is a schematic perspective view of a stacked set of four trays with fruit packed in a box.

The packing tray 10 has a cellular construction with a plurality of cell pockets 20 formed to accommodate the fruit F to be packed therein (FIGS. 5 and 9). The tray is generally rectangular shaped with a longitudinal dimension X and a lateral dimension Y (FIG. 2). The perimeter 14 is formed by two opposing longitudinal edges 17A-17B and two opposing lateral edges 18A-18B. To maximize the economy of the packing tray 10 it is preferred that the greatest number of the cell pockets 20 be provided within the area X-Y that is feasible. The peripheral edge 14 may be interrupted by a relief 16 (FIG. 5) to provide rigidity to the packing tray 10. The relief 16 also acts as a peripheral channel, e.g., to prevent moisture from spilling over the sides of the tray and leaching into the sides of a cardboard box B holding a stack of trays as seen in FIG. 10. One or more reinforcing ribs 19 (FIG. 3) may also be formed in the tray for greater rigidity.

The packing tray 10 has an upper surface 11 and an opposing lower surface 12. The cell pockets 20 have concave inner surfaces formed from the top surface of the tray, each cell pocket having a central transverse axis A (FIG. 4) extending through the center lowermost sump area 50, the transverse axis being disposed transverse to the reference plane 7 defined by the peripheral edge 14 of the tray. Each cell pocket in this example is a generally truncated portion of a sphere, which truncated portion is relatively shallow (interior depth D) so as to accommodate a greater number of stacked packing trays 10 and fruit F when a set of trays is packed one above the other (FIGS. 5 and 9). When stacking the trays, each alternating tray is rotated 180 degrees from the adjacent tray, so that the cell dividers 30 between each two adjacent cell pockets 20 in a longitudinal row (parallel to X) above a piece of fruit F held in a cell pocket of the next lowermost tray. This is shown most clearly in FIG. 5, wherein a portion of two stacked trays are shown with apples F disposed in each of the cell pockets 20U of the upper tray 10U and cell pockets 20L of the lower tray 10L. The apples are lying on their sides so that their stems are not crushed by the above tray. An apple held in a cell pocket 20L of the lower tray 10L is engaged at one or more points on its surface by a bottom surface 12U of the upper tray 10U, e.g., one or more of the adjacent outer surfaces of the cell divider 30U and/or the adjacent walls of the cell pockets 20U which together comprise a generally convex portion 32U. By thus nesting the apple between the first and second trays, between a cell pocket below and a cell divider (and/or cell pockets) above, movement of the apple is relatively restricted. This helps prevent bruising and damage to the apple during storage and transport.

The cell pockets 20 are arranged in longitudinal rows (FIG. 2), where it is preferred that alternating rows include odd and even numbers of cell pockets. More preferably, the even number rows include one more cell than the odd number rows. For example, FIG. 2 is a top plan view of a tray 10 having a first longitudinal row that includes four cell pockets 20A-20D, each cell pocket having a lowermost sump area 50A-50D disposed at the center of the cell pocket, the cell centers 50A-50D being aligned along a longitudinal axis 21A that is generally parallel to the two opposing longitudinal side edges 17A-17B of the tray 10.

A second longitudinal row includes three cell pockets 20E-20G aligned along a second parallel longitudinal axis 21B, disposed adjacent to the first row of cell pockets 20A-20D. The cell pocket centers in the second row are offset equidistant between the cell pocket centers of the first row. For example, in FIG. 2, the center 50E of cell pocket 20E in the second row along axis 21B is equidistant from the lateral axes 22A and 22C on which the centers 50A and 50B of cell pockets 20A and 20B in the first row along axis 21A are respectively disposed. The packing tray 10 further includes a third row with four cell pockets aligned along a third longitudinal axis 21C, wherein the cell pocket centers of the third row are aligned in a lateral direction (e.g., along axes 22A-22G) with the cell pocket centers of the first row. Further, a fourth row of three cell pockets are adjacent to the third row, the cell centers of the fourth row on longitudinal axis 21D being aligned with the cell centers of the second row (e.g., see axes 22B, 22D and 22F). Thus, in this example there are 14 cell pockets arranged in an array of rows and columns, with the cell pocket centers of each adjacent row offset equidistant between the cell centers of the next row.

Figure 1:
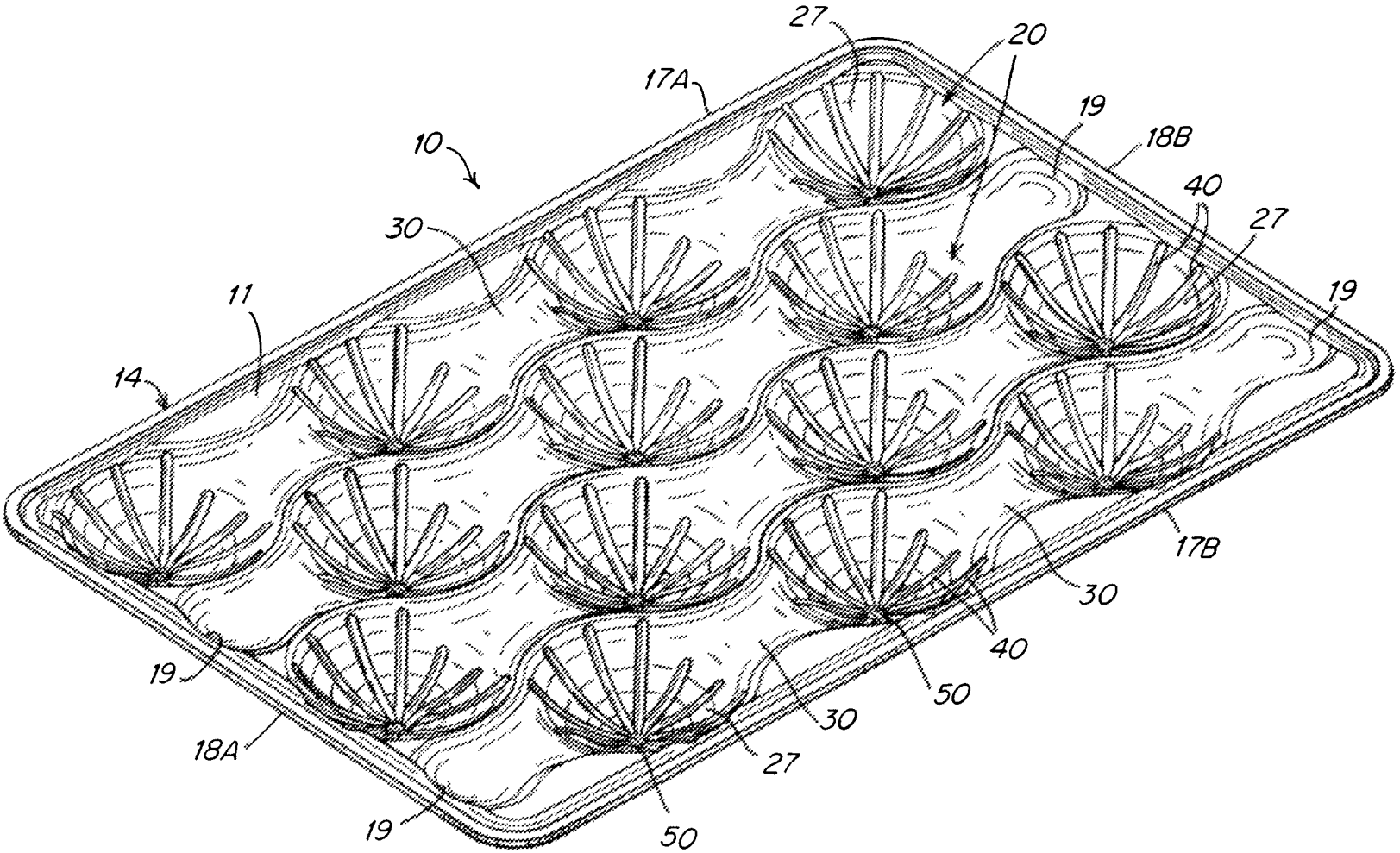
FIG. 1 is a top perspective view of one embodiment of a packing tray according to the present invention.

The drainage system of the present invention will now be described with respect to the packing tray 10 of the present embodiment. FIG. 1 shows a plurality of cell pockets 20, each having a concave inner surface 27 and a plurality of drainage channels 40, shown here as grooves, formed in the inner surface of the cell pocket and disposed in a radial pattern that intersect in a sump area 50 at the lowermost point of the cell pocket 20. In this embodiment, as shown in detail in FIGS. 6-8, the sump area 50 has a recess 52 with a relatively thinner wall thickness T1 than the wall thickness T2 of an adjacent cell pocket area (FIG. 8), and the sump area 50 includes two punched out wall portions forming two flap doors 56A, 56B on either side of a median 54, the medium remaining connected to the cell pocket wall, while the flap doors form openings 58A, 58B through the sump area for draining water from the inner (upper) surface 27 of the cell pocket to the outer (lower) surface 28 of the cell pocket. The outer surface 28 of the pocket has drain channels 70, here shown as two drain channels 70A, 70B radially disposed to intersect one each of the openings 58A, 58B in the sump area respectively. The two drain channels on the outer surface of the cell pocket help move the water through the openings and away from the sump area so that the moisture can be dispersed and ideally provide a larger area for evaporation of such moisture.

Figure 6:
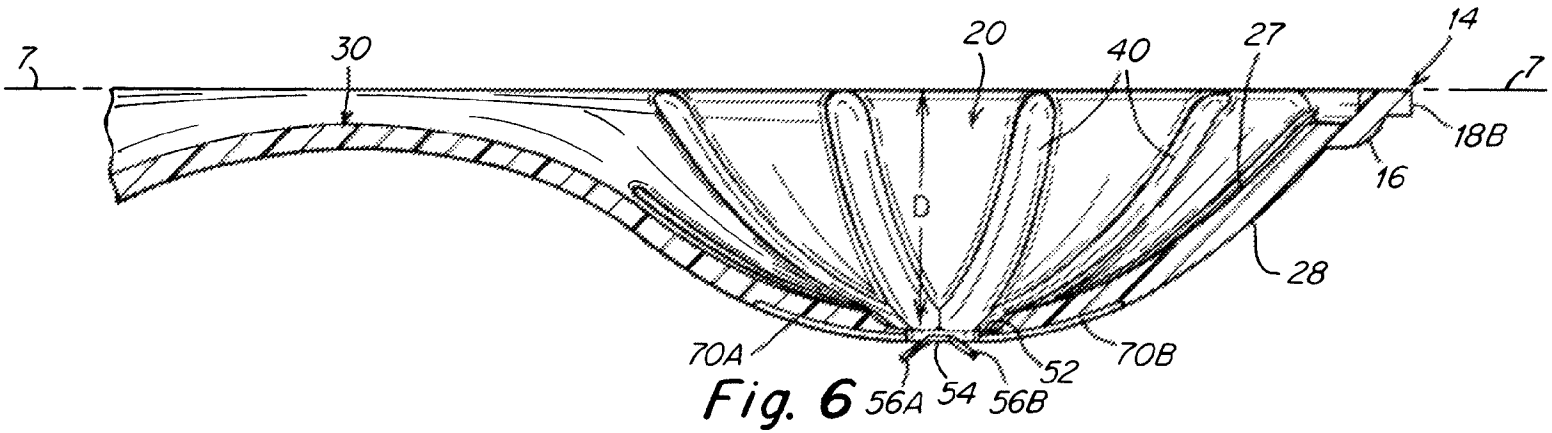
FIG. 6 is a cross-sectional view of a cell pocket taken along line 6-6 of FIG. 2.
Figure 8:
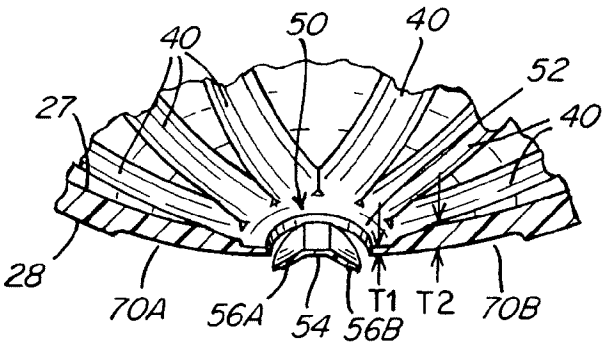
FIG. 8 is a fragmentary perspective cross-sectional view of the sump area of FIGS. 6 and 7.
Figure 7:
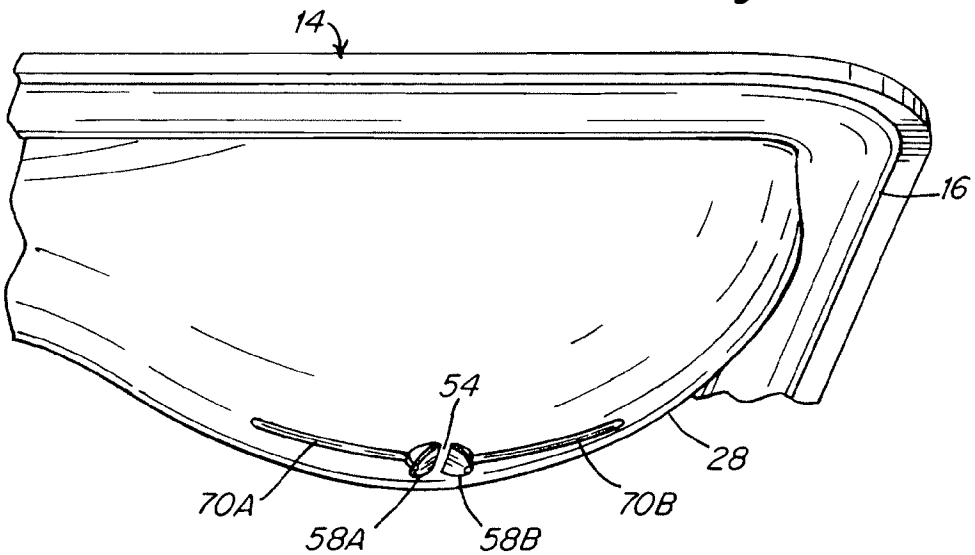
FIG. 7 is a fragmentary bottom perspective view of the cell pocket of FIG. 6.

FIG. 5 shows moisture drops M condensing on the apples F, which moisture M then falls onto the inner surface 27 of the cell pocket, is directed by the inner channels 40 to the sump area 50, and is released through the openings 58 in the sump area. As illustrated in the stacking arrangements shown in FIG. 5, the water draining from the sump area in the upper tray 10U falls transversely down onto an upper surface portion 34L of the cell divider 30L in the adjacent lower tray 10L, immediately below the drainage openings 58U of sump area 50U. The water that falls on surface portion 34L will then be channeled down to the adjacent cell pockets 20L in the lower tray 10L (as best shown in FIG. 6).

FIG. 9 shows a stack 80 of four trays 10A-10D stacked one on top of the other, each cell pocket 20 holding an apple F, and illustrating how the sump area 50 of the immediately above tray is centered on the cell divider 30 of the immediately adjacent lower tray. This alternating arrangement of cell pockets and cell dividers is accomplished by rotating each adjacent stacked tray 180 degrees. The trays in the stack do not have to be level (parallel to standing surface 4) to drain properly. The inner channels help move the water to the sump area and through the drainage holes, while the outer channels also divert water away from the fruit.

The cell density in a packing tray (i.e., number of cell pockets per unit area) is inversely proportional to the depth of the cell pockets. In other words, a greater number of shallower cell pockets can be formed in a tray of given area than a number of deeper cell pockets, in the same area. It is preferred that the maximum full diameter D1 of the cell pockets (FIG. 5) be less than the nominal maximum diameter D2 of the fruit F, thereby providing for relatively shallow cell pockets which can be densely formed.

In various embodiments, the plastic material of the tray is preferably one or more of polystyrene (e.g., polystyrene foam), polyester (e.g., polyethylene terephthalate (PET)), polyolefin (e.g., polyethylene (PE), polypropylene (PP)), or polylactic acid (PLA), including homopolymers, copolymers, mixtures and blends thereof, and including virgin and reclaimed (recycled) materials, and whether solid or foamed.

The following ranges of dimensions can be used in various embodiments of the invention: the interior depth D of a cell pocket having a range of 0.75 to 2 inches inclusive; and the interior maximum full diameter D1 of the cell pocket having a range of 2 to 4 inches inclusive; the wall thickness T1 of the cell pocket having a range of 0.05 to 0.16 inches inclusive; and the wall thickness of the channels having range of 0.01 to 0.06 inches inclusive. The actual dimensions will depend upon the tray material and on the dimensions of the fruit F, including the nominal diameter D2.

Typically, multiple trays are packed in a box for shipment. In one embodiment (FIG. 10), four stacked trays 10A-10D are enclosed in a paperboard shipping box B, each tray 10 having 14 pockets, and each pocket holding one object, a total of 4×14=56 objects packaged in one box (e.g., 56 apples, aligned lengthwise in the pockets with their stems parallel to the reference plane).

When packed, the packing trays 10U, 10L are arranged such that the fruit F of the lower stack packing tray 10L is nested between, and in abutting contact with the exterior surfaces of one or more cell pockets (and/or cell dividers) of the upper packing tray 10U. The abutting engagement of the cell pockets and/or cell dividers against the fruit F provides a holding force therefore. The cell pockets 20 and cell dividers 30 are preferably formed with smooth outer surfaces to limit damage to the fruit F. Also, the tray material preferably provides compressability which deflects under weight of fruit F and also acts to limit damage to the fruit F.

As is readily apparent, numerous modifications and changes may readily occur to those skilled in the art. Hence, the disclosure herein is not intended to limit the invention to the exact construction and operation shown and described. All suitable equivalents are included within the scope of the invention as claimed.

The invention claimed is:

1. A packing tray of plastic material for packing fragile objects, the packing tray comprising:

a peripheral edge extending about the perimeter of the tray, the peripheral edge having an upper surface defining a reference plane;

a plurality of generally concave cell pockets formed in the tray extending transversely from the reference plane to accommodate fragile objects to be packed in the cell pockets;

each cell pocket having a lowermost sump area having at least one flap door punched out but not removed from the cell pocket forming an opening in the cell pocket;

a plurality of drainage channels on an inner surface of the cell pocket for directing moisture to the sump area; and a plurality of drainage channels on an outer surface of the cell pocket intersecting at the sump area to assist with drainage through the opening.

2. The packing tray of claim 1, including cell dividers separating the cell pockets and disposed a lesser distance from the reference plane than the sump areas.

3. The packing tray of claim 2, wherein the cell pockets and cell dividers are arranged to enable a first stacking tray to be stacked on a second packing tray when the trays are rotated 180 degrees.

4. The packing tray of claim 1, wherein the sump area has a lesser wall thickness than an adjacent area of the cell pocket.

5. The packing tray of claim 1, wherein the sump area includes two flap doors forming two openings.

6. The packing tray of claim 1, wherein the cell pockets are arranged in longitudinal rows, with cell pockets in alternating rows having cell pocket centers offset and equidistant from the cell pocket centers in an adjacent row.

7. The packing tray of claim 1, wherein:

an even number of the cell pockets are included in a first row and an odd number of the cell pockets are included in a second row adjacent to the first row.

8. The packing tray of claim 7, wherein:

the first row includes one more cell pocket than the second row.

9. The packing tray of claim 1, wherein:

the plastic material comprises one or more of polystyrene, polyester, polyolefin, polypropylene (PP), or polylactic acid (PLA), including homopolymers, copolymers, mixtures and blends thereof, and including virgin and reclaimed (recycled) materials, and whether solid or foamed.

10. The packing tray of claim 1, wherein:

the plastic material comprises polystyrene foam.

11. The packing tray of claim 1, wherein:

the tray is unitarily formed.

12. The packing tray of claim 2, wherein:

each cell divider and the adjacent cell pockets form a generally convexly shaped portion on a lower surface of the tray.

13. The packing tray of claim 2, wherein:

each cell divider includes an upper surface shaped to channel water to an adjacent cell pocket.

14. A stack of packing trays comprising at least two packing trays of claim 1 stacked one on top of the other with the fragile objects disposed in the cell pockets and the second tray rotated 180 degrees with respect to the first tray.

15. A stack of packing trays comprising at least two packing trays of claim 2 stacked one on top of the other with the fragile objects disposed in the cell pockets and the second tray rotated 180 degrees with respect to the first tray.

16. A stack of packing trays comprising at least two packing trays of claim 12 stacked one on top of the other with the fragile objects disposed in the cell pockets and the second tray rotated 180 degrees with respect to the first tray.

17. A method of making the packing tray of claim 1, including:

providing a unitary sheet of plastic material;

forming the cell pockets in the sheet by molding; and punching out the at least one flap door in the sump area of each formed cell pocket.

18. A packing tray of plastic material for packing fragile objects, the packing tray comprising:

a peripheral edge extending about the perimeter of the tray, the peripheral edge having an upper surface defining a reference plane;

a plurality of cell pockets formed in the tray, each cell pocket comprising a generally truncated portion of a sphere extending transversely from the reference plane to accommodate a fragile object to be packed in the cell pocket;

each cell pocket having a lowermost sump area comprising a recess in an upper surface of the cell pocket and having at least one flap door punched out but not removed from the cell pocket forming an opening in the cell pocket;

a plurality of drainage channels extending radially on the inner surface of the cell pocket;

for directing moisture to the sump area; and a plurality of drainage channels extending radially on an outer surface of the cell pocket and intersecting at the sump area to assist with drainage through the opening.

19. The packing tray of claim 18, including cell dividers separating the cell pockets are disposed a lesser distance from the reference plane than the sump areas, wherein the cell pockets and cell dividers are arranged to enable a first stacking tray to be stacked on a second packing tray when the trays are rotated 180 degrees.

20. The packing tray of claim 19, wherein:

each cell divider and the adjacent cell pockets form a generally convexly shaped portion on a lower surface of the tray.

* * * * *